US007770245B2

(12) United States Patent
Cheng et al.

(10) Patent No.: US 7,770,245 B2
(45) Date of Patent: Aug. 10, 2010

(54) PLAYARD WITH BASSINET

(75) Inventors: Kenny Cheng, Taipei (TW); Shun-Min Chen, Taipei (TW); Nan-Gui Bu, Taipei (TW)

(73) Assignee: Wonderland NurseryGoods Co., Ltd., Neihu, Taipei (TW)

( * ) Notice: Subject to any disclaimer, the term of this patent is extended or adjusted under 35 U.S.C. 154(b) by 24 days.

(21) Appl. No.: 12/116,187

(22) Filed: May 6, 2008

(65) Prior Publication Data

US 2009/0025148 A1 Jan. 29, 2009

Related U.S. Application Data

(60) Provisional application No. 60/952,245, filed on Jul. 27, 2007.

(51) Int. Cl.
*A47D 7/00* (2006.01)

(52) U.S. Cl. ..... 5/93.1; 5/93.2; 5/655

(58) Field of Classification Search ..... 5/93.1, 5/93.2, 99.1, 655

See application file for complete search history.

(56) References Cited

U.S. PATENT DOCUMENTS

| | | | | |
|---|---|---|---|---|
| 4,317,245 | A * | 3/1982 | El-Amin | 5/497 |
| 5,163,191 | A * | 11/1992 | Chan | 5/98.1 |
| 5,339,470 | A * | 8/1994 | Shamie | 5/98.1 |
| 5,697,111 | A | 12/1997 | Dillner | |
| 6,058,528 | A | 5/2000 | Yang | |
| 6,418,575 | B1 | 7/2002 | Cheng | |
| 6,421,850 | B1 * | 7/2002 | Welsh, Jr. | 5/99.1 |
| 6,430,762 | B1 * | 8/2002 | Cheng | 5/93.2 |
| 6,434,767 | B1 * | 8/2002 | Welsh, Jr. | 5/93.2 |
| 7,096,874 | B2 * | 8/2006 | Forshpan | 135/96 |
| 2003/0061657 | A1 * | 4/2003 | Longenecker et al. | 5/99.1 |
| 2005/0034232 | A1 * | 2/2005 | Martin | 5/93.1 |
| 2007/0017025 | A1 * | 1/2007 | Myer | 5/99.1 |

* cited by examiner

*Primary Examiner*—Robert G Santos
*Assistant Examiner*—Brittany M Wilson
(74) *Attorney, Agent, or Firm*—Winston Hsu

(57) ABSTRACT

The playard includes a frame body and a bassinet detachably mounted on the frame body. An opening and a cover that covers onto the opening are configured at the bottom panel of the bassinet. When the cover opens relative to the opening, a folding device at the bottom of the frame body can be operated by a user's hand sticking into the opening for folding the playard to a smaller size without the need of removing the bassinet. A height adjustment device is further configured on the side panels of the bassinet for adjusting the height of the bassinet by selectively setting the bassinet in a first using state that has a shallow depth or in a second using state that has a deep depth.

20 Claims, 6 Drawing Sheets

PLAYARD WITH BASSINET

CROSS REFERENCE TO RELATED APPLICATIONS

This application claims the benefit of U.S. Provisional Applications No. 60/952,245, which was filed on Jul. 27, 2007 and is incorporated herein by reference.

BACKGROUND OF THE INVENTION

1. Field of the Invention

The present invention is related to a playard, and particularly, to a foldable playard with bassinet assembly without removing the bassinet and having a height adjustment device on the bassinet.

2. Description of the Prior Art

Playards in the prior art generally have two using states. One using state of the playard is shown in FIG. 1, where a playard frame 3 is assembled with a detachable bassinet 7 and a cushion (not shown in the figure) is placed at the bottom of the bassinet 7 for younger baby sleeping. The other using state of the playard is shown in FIG. 2, where a cushion 2 is placed at the bottom of the playard frame 3 so that an older child can sleep or play therein. The bassinet 7, however, needs to be removed from the playard frame 3 first when the playard changes from the using state shown in FIG. 1 to the other using state shown in FIG. 2. On the other hand, the folding device (not shown in the figure) of the playard is generally configured at the bottom of the playard frame 3 and the bassinet is required to be removed from the playard frame 3 first so that the user can operate the folding device to fold the playard frame 3 further. Such operation causes inconvenience for the parents and the removed bassinet is very much likely to be forgotten and difficult for storage.

SUMMARY OF THE INVENTION

The present invention provides a playard. The playard comprises a frame body having a folding device at the bottom for folding the playard, and a bassinet mounted on the frame body. The bassinet comprises a bottom panel, and a plurality of side panels, each connecting to the bottom panel with one end and to the frame body with the other end. The bottom panel has an opening and a cover configured near the opening and capable of opening or closing relative to the opening. The playard is folded by operating the folding device through the opening when the cover opens relative to the opening.

The present invention also provides a playard. The playard comprises a frame body, and a bassinet mounted on the frame body and selectively set in a first using state that has a shallower depth or a second using state that has a deeper depth. The bassinet comprises a bottom panel, a plurality of side panels, each connecting to the bottom panel with one end and to the frame body with the other end, and a height adjustment device comprising a first engaging component and a second engaging component mounted on the plurality of side panels and operable to engage with each other or disengage from each other so as to selectively set the bassinet in the first using state or the second using state respectively.

The present invention also provides a bassinet for removably mounted on a playard. The bassinet comprises a bottom panel, a plurality of side panels, and a first zipper component and a second zipper component mounted on the plurality of side panels. Each of the side panels has one end connected to the bottom panel and the other end removably connected to the playard. The bassinet is selectively set on a first using state that the first zipper component is engaged with the second zipper component and a second using state that the first zipper component is disengaged from the second zipper component.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
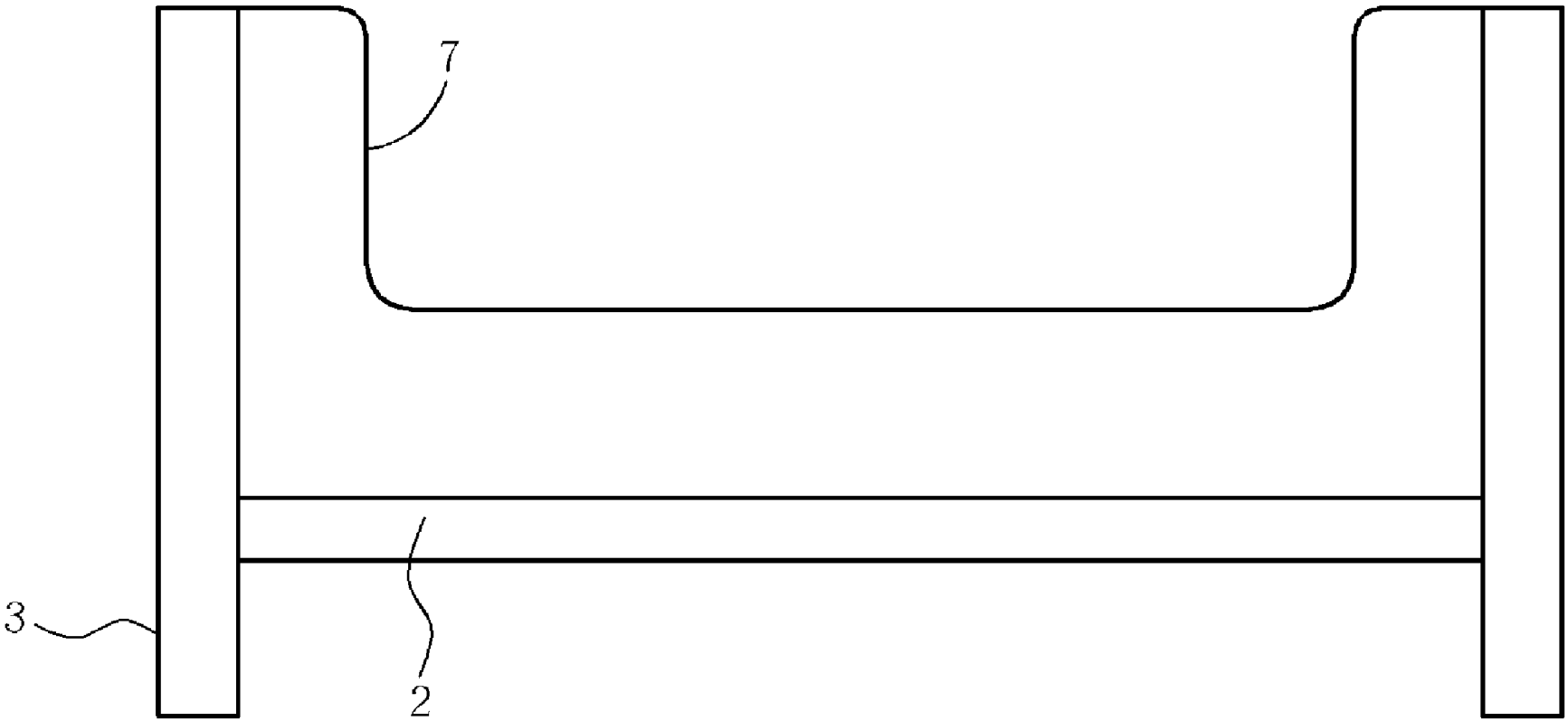
FIG. 1 PRIOR ART
FIG. 1 is an illustration of a using state for a playard frame installed with a bassinet in the prior art.
Figure 2:
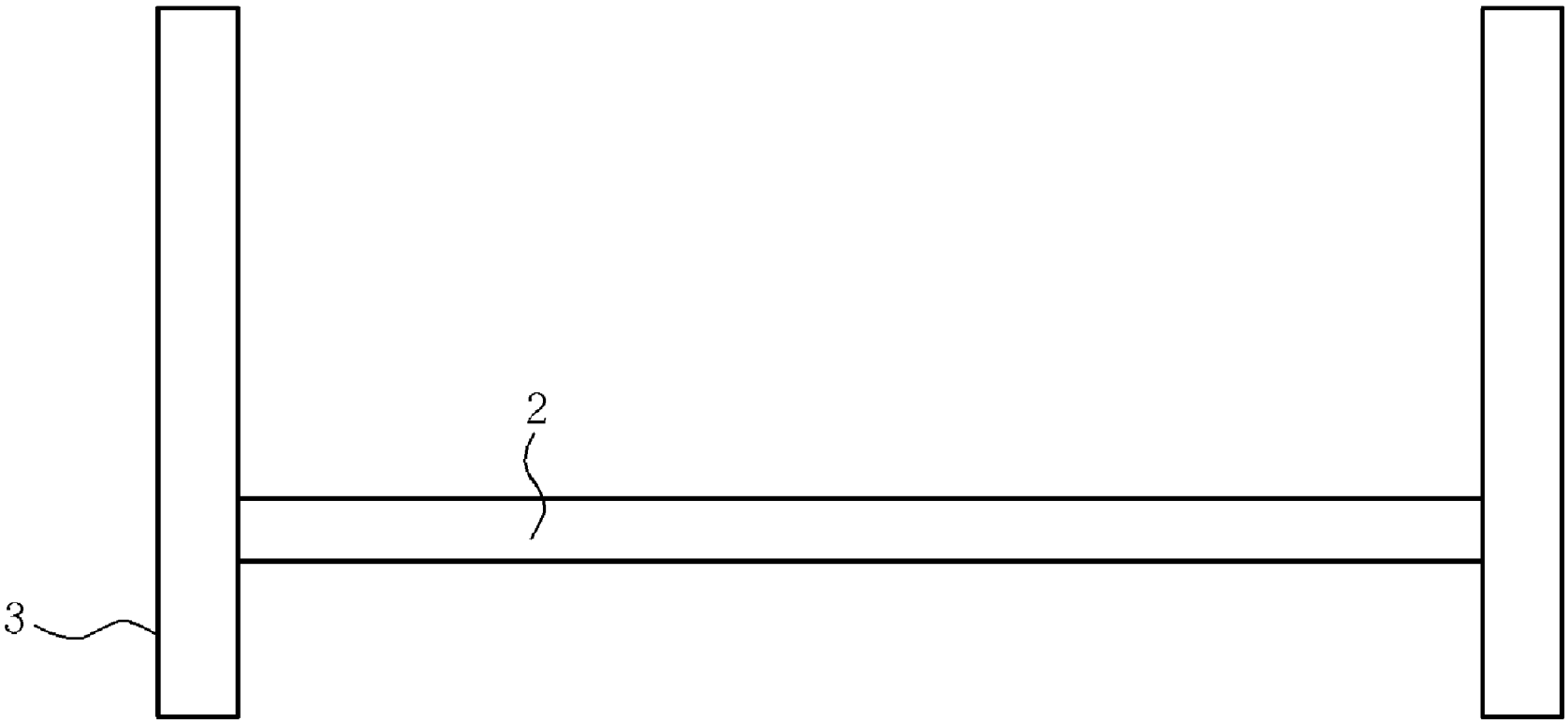
FIG. 2 PRIOR ART
FIG. 2 is an illustration of a using state for the playard with the bassinet removed.
Figure 3:
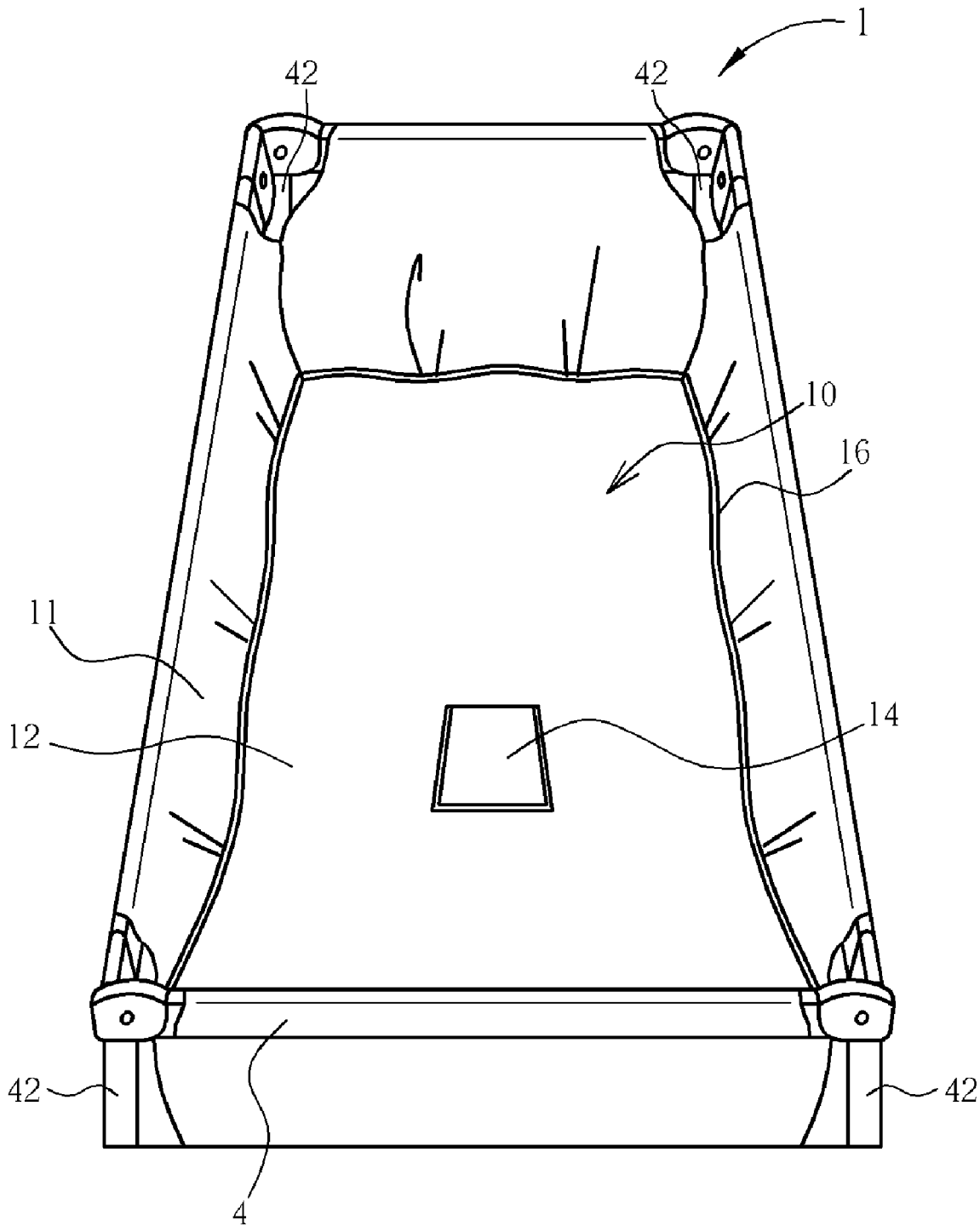
FIG. 3 is an illustration of an embodiment of the playard with bassinet according to the present invention.

Please refer to FIG. 3, which is an illustration of a playard 1 with bassinet 10 according to the present invention. The playard 1 comprises a frame body 4 and a bassinet 10. The frame body 4 is foldable and comprises a plurality of standing posts 42. A folding device 41 (referring to FIG. 4) is mounted at the bottom of the frame body 4 and can be operated by user to pull the standing posts 42 to approach to one another and fold the playard 1 to a smaller size for storage or carrying. In the embodiment, the bassinet 10 is a separated assembly and can be mounted on the frame body 4 in a detachable way. When the bassinet 10 is removed from the frame body 4, the frame body 4 with deeper depth and larger containing room can work as a playpen or suit for older toddlers. While the bassinet 10 is mounted on the frame body 4, the bassinet 10 is hanged on the frame body 4 and locates at a predetermined height above the bottom of the frame body 4 and allows an infant for lying thereon or diaper change.

Figure 4:
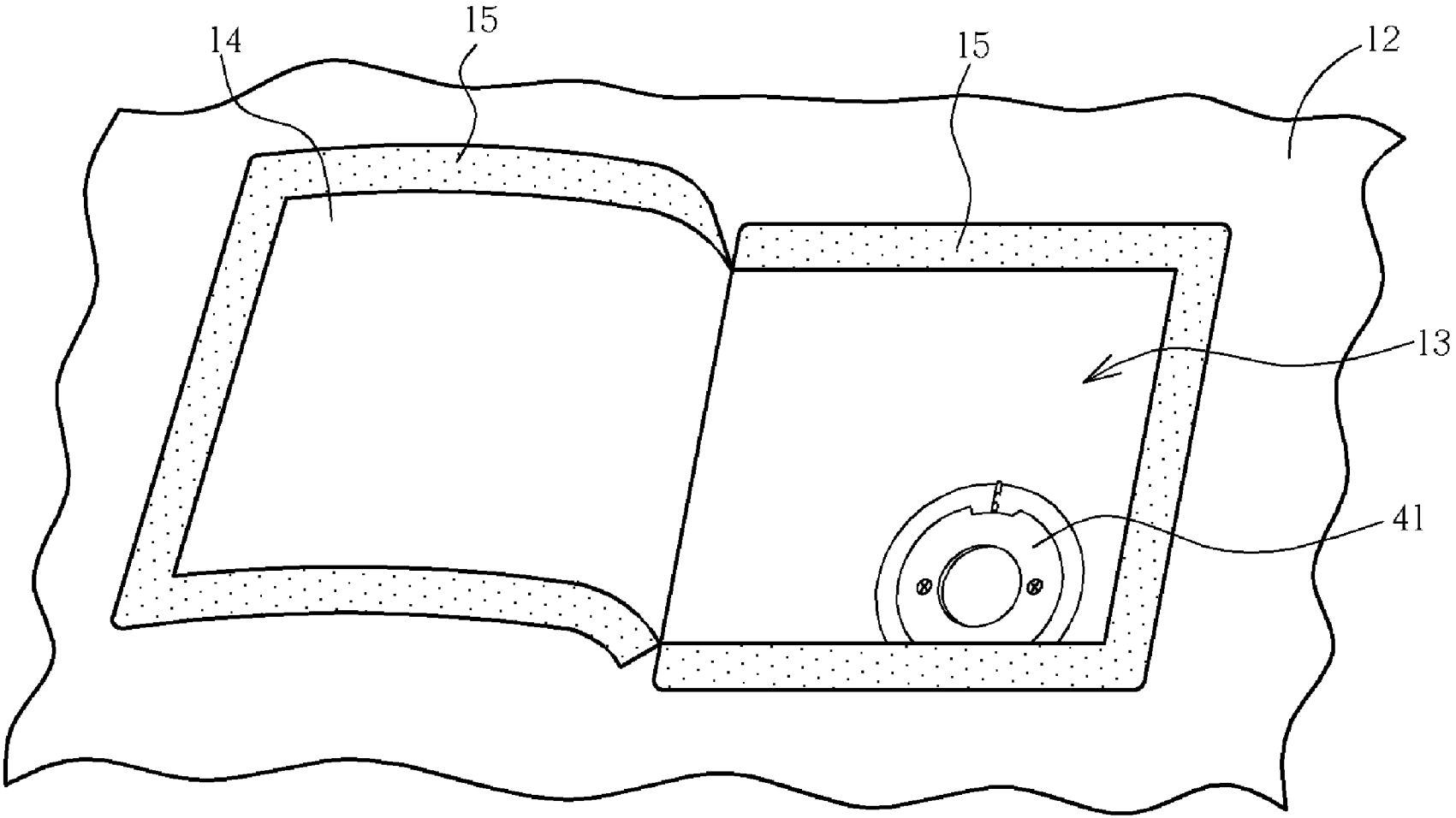
FIG. 4 is an illustration of the partial view of the bassinet.

The bassinet 10 comprises a bottom panel 12 and four side panels 11. Each of the side panels 11 connects to the bottom panel 12 with one end and has a connector (not shown in the figure, the connector can be a hook or any connecting device in the prior art) connecting to the other end and mounting on the frame body 4. Please refer to FIG. 4. FIG. 4 is an illustration of the partial view of the bassinet 10. The bottom panel 12 of the bassinet 10 has an opening 13, which lies at the location right above the folding device 41 of the frame body 4. A cover 14 is further configured near the opening 13 at the bottom panel 12 and can be operated to open or close relative to the opening 13. The cover 14 is in a closed state in FIG. 3 and an opened state in FIG. 4. Connection devices 15 are interactively configured on the surrounding of the cover 14 and the opening 13 respectively. In the embodiment, the connection devices 15 are hook-loops while in other embodiment they can be other forms of connection components. When the cover 14 is in the closed state as shown in FIG. 3, the connection devices 15 on the surrounding of the cover 14 and the opening 13 are connected to each other such that the cover 14 fully covers the opening 13. A cushion 5 (referring to FIG. 6) can further be place on the bottom panel 12 of the bassinet 10 for an infant lying thereon. When the playard 1 is required to be folded up, the operator simply pulls up the cover 14 to the opened state shown in FIG. 4 and sticks his/her hand into the opening 13 to operate the folding device 41 at the bottom of the frame body 4 directly and the bassinet 10 is not required to remove. In this embodiment, the side panels 12 and the bottom panel 11 of the bassinet 10 are made up of flexible material like soft goods, which will not interfere the folding of the frame body 4 when the standing posts 42 approach to one another.

Figure 5:
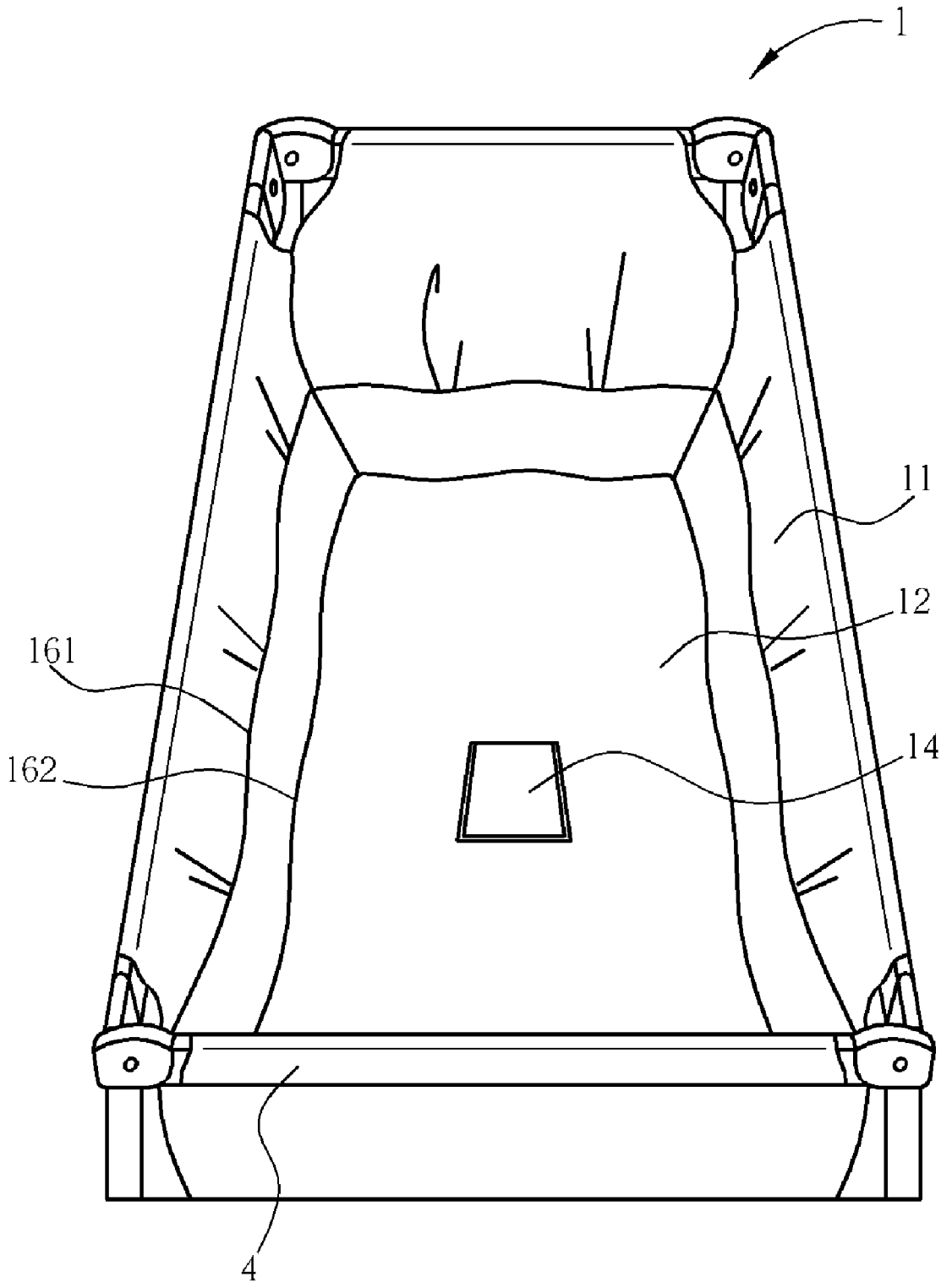
FIG. 5 is an illustration of a second using state of the bassinet according to the present invention.
Figure 6:
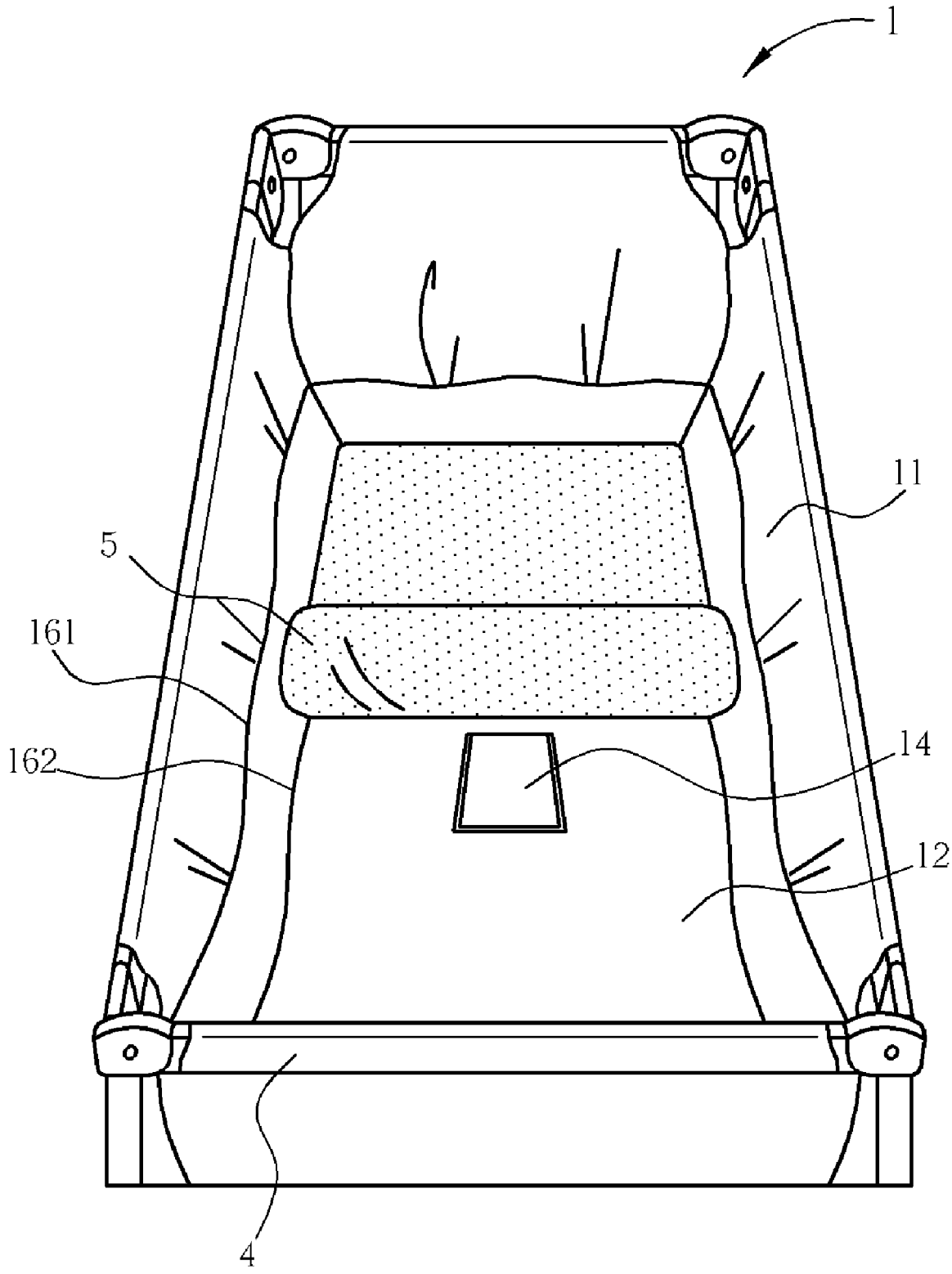
FIG. 6 is an illustration of the bassinet with a half-extended cushion.

Additionally, the bassinet 10 mounted inside the playard 1 can further have different heights through a height adjustment device 16. The bassinet 10 may have a first using state as shown in FIG. 3 for the infants to lie thereon or a second using state as shown in FIG. 5 for toddlers to stand thereon. The second using state can provide similar deeper roomy environment as the stand-along frame body 4 without removing the bassinet 10 from the frame body 4. The height adjustment device 16 comprises a first engaging component 161 and a second engaging component 162 correspondingly as shown in FIG. 5 and FIG. 6. In the embodiment the engaging components are realized with zippers configured on the four side panels 11 of the bassinet 10. As FIG. 3 shows, the bassinet 10 is set in the first using state, having a shallower depth, when the first engaging component 161 engages with the second engaging component 162, i.e., the bottom panel 12 locates at a higher position relative to the playard 1 and the bassinet 10 can be used as conventional bassinet for the infant lying thereon. When the bassinet 10 is required to be set in the second using state, user can disengage the first engaging component 161 from the second engaging components so that the four side panels 11 of the bassinet 10 extend to what is shown in FIG. 5. This causes the bottom panel 12 of the bassinet 10 to locate on the bottom of the playard 1, or locate in a lower position relative to the playard 1 and has a deeper depth, which provides larger room as a conventional playpen for older toddlers. The bassinet 10 can be placed with a cushion 5 on the bottom panel 12 either in the first using state or the second using state. FIG. 6 shows that the bassinet 10 is set in the second using state and the cushion 5 is in a half extended state. When the playard 1 needs to be folded up, it can be set to the second using state so that the opening 13 gets close to the folding device 41. The operator then only needs to remove the cushion 5, pull up the cover 14, and stick his/her hand into the opening 13 to operate the folding device 14 and fold the playard 1. The bassinet 10 is not required to remove from the playard 1 in advance.

The playard disclosed in the present invention comprises a frame body and a bassinet detachably mounted on the frame body. An opening and a cover that covers onto the opening are configured at the bottom panel of the bassinet. When the cover opens relative to the opening, a folding device at the bottom of the frame body can be operated by user's sticking hand into the opening for folding the playard to a smaller size without the need of removing the bassinet. A height adjustment device is further configured on the side panels of the bassinet for adjusting the height of the bassinet by selectively setting the bassinet in a first using state that has a shallow depth or in a second using state that has a deep depth.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A playard, comprising:

a frame body having a folding device at the bottom for folding the playard; and a bassinet mounted on the frame body, comprising:

a bottom panel; and a plurality of side panels, each connecting to the bottom panel with one end and to the frame body with the other end;

wherein the bottom panel has an opening positioned distally from said plurality of side panels and located above the folding device of the frame body sized to permit a user's hand to pass through and a cover configured near the opening and capable of opening or closing relative to the opening, the playard folded by operating the folding device through the opening when the cover opens relative to the opening.

2. The playard of claim 1, wherein the bassinet comprises a plurality of connectors, each connecting to the other end of the side panel, and the bassinet is detachably mounted on the frame body via the plurality of connectors.

3. The playard of claim 2, wherein the plurality of connectors are hooks.

4. The playard of claim 1, wherein the bassinet comprises a height adjustment device configured on the plurality of side panels and comprising a first engaging component and a second engaging component, and the bassinet selectively set on a first using state where the first engaging component is engaged with the second engaging component and a second using state where the first engaging component is disengaged from the second engaging component.

5. The playard of claim 4, wherein when the bassinet is set in the second using state, the bottom panel of the bassinet is placed on the bottom of the frame body and the bassinet has a larger depth than when the bassinet is set in the first using state.

6. The playard of claim 4, wherein the height adjustment device is a zipper.

7. The playard of claim 1, wherein the bassinet further comprises a connection device configured between the cover and the surrounding of the opening for fastening the cover to the bottom panel when the cover closes relative to the opening.

8. The playard of claim 7, wherein the connection device is a hook-loop.

9. The playard of claim 1, wherein the opening is configured at the bottom panel of the bassinet and is located right above the folding device of the frame body.

10. The playard of claim 1, wherein the side panels and the bottom panel of the bassinet are made up flexible material so that the bassinet will fold with the frame body without interfering the frame body folding.

11. A playard, comprising:

a frame body having a folding device at the bottom for folding the playard; and a bassinet mounted on the frame body and selectively set in a first using state that has a shallower depth or a second using state that has a deeper depth, the bassinet comprising:

a bottom panel;

a plurality of side panels, each connecting to the bottom panel with one end and to the frame body with the other end; and a height adjustment device comprising a first engaging component and a second engaging component mounted on the plurality of side panels and operable to engage with each other or disengage from each other so as to selectively extend the plurality of side panels further toward the bottom of the frame body and set the bassinet in the first using state or the second using state respectively;

wherein the bottom panel has an opening positioned distally from said plurality of side panels and located above the folding device of the frame body sized to permit a user's hand to pass through for folding the playard by operating the folding device through the opening.

12. The playard of claim 11, wherein the bassinet further comprises a cover configured near the opening at the bottom panel and capable of opening or closing relative to the opening.

13. The playard of claim 12, wherein the bassinet further comprises a connection device configured between the cover and the surrounding of the opening for fastening the cover to the bottom panel when the cover closes relative to the opening.

14. The playard of claim 13, wherein the connection device is a hook-loop.

15. The playard of claim 11, wherein the bassinet comprises a plurality of connectors, each connecting to the other end of the side panel, and the bassinet is detachably mounted on the frame body via the plurality of connectors.

16. The playard of claim 11, wherein the opening is configured at the bottom panel of the bassinet and is located right above the folding device of the frame body.

17. The playard of claim 11, wherein the height adjustment device is a zipper.

18. The playard of claim 11, wherein when the bassinet is set in the second using state, the bottom panel of the bassinet is placed on the bottom of the frame body and the bassinet has a larger depth than when the bassinet is set in the first using state.

19. A bassinet for removably mounting on a playard, comprising:

a bottom panel comprising an opening positioned distally from a plurality of side panels for allowing a user's hand to pass through;

said plurality of side panels, each having one end connected to the bottom panel and the other end removably connected to the playard; and a first zipper component and a second zipper component mounted on the plurality of side panels;

wherein the bassinet is selectively set on a first using state that the first zipper component is engaged with the second zipper component and a second using state that the first zipper component is disengaged from the second zipper component extending the plurality of side panels further than when in the first using state.

20. A bassinet of claim 19, further comprising a cover configured near the opening and capable of opening or closing relative to the opening.

* * * * *